US009714802B1

(12) United States Patent
Storch

(10) Patent No.: US 9,714,802 B1
(45) Date of Patent: Jul. 25, 2017

(54) FIREARM GAS TUBE ASSEMBLY

(71) Applicant: Midwest Industries, Inc., Waukesha, WI (US)

(72) Inventor: Troy Storch, Wales, WI (US)

(73) Assignee: Midwest Industries, Inc., Waukesha, WI (US)

( * ) Notice: Subject to any disclaimer, the term of this patent is extended or adjusted under 35 U.S.C. 154(b) by 0 days.

(21) Appl. No.: 15/214,038

(22) Filed: Jul. 19, 2016

(51) Int. Cl.

| | |
|---|---|
| ***F41A 5/00*** | (2006.01) |
| ***F41A 5/28*** | (2006.01) |
| ***F41G 11/00*** | (2006.01) |
| ***F41G 1/06*** | (2006.01) |

(52) U.S. Cl.
CPC ..... *F41A 5/28* (2013.01); *F41G 1/06* (2013.01); *F41G 11/003* (2013.01)

(58) Field of Classification Search
USPC ..... 89/193, 191.01, 191.02, 192
See application file for complete search history.

(56) References Cited

U.S. PATENT DOCUMENTS

| | | | | |
|---|---|---|---|---|
| 8,393,259 | B2 * | 3/2013 | Larue | F41A 5/28 89/193 |
| 2014/0090550 | A1 * | 4/2014 | Wilcox | F41A 5/28 89/193 |
| 2015/0204627 | A1 * | 7/2015 | Gomez | F41A 5/18 89/193 |
| 2017/0045321 | A1 * | 2/2017 | Larue | F41A 5/20 |

* cited by examiner

*Primary Examiner* — J. Woodrow Eldred
(74) *Attorney, Agent, or Firm* — Boyle Fredrickson, SC

(57) ABSTRACT

A gas tube assembly for semiautomatic firearms is defined by a body having a first end, a second end, and a passage formed through the body between the respective ends. The first end of the body of the gas tube is constructed to cooperate with a gas block and the second end of the body is constructed to cooperate with a forward facing end of a receiver assembly. A first projection and a second projection each extend in a respective outward radial direction from the body proximate the second end of the body and a respective adjuster is associated with each respective projection. The adjusters are configured to movably cooperate with the respective projection to align the second end of the body relative to the receiver assembly.

20 Claims, 6 Drawing Sheets

FIREARM GAS TUBE ASSEMBLY

BACKGROUND OF THE INVENTION

The present invention relates generally to mounting arrangements associated with securing accessories to an underlying semi-automatic or automatic firearm assembly. More specifically, the present invention relates to a gas tube assembly, and firearms equipped therewith, wherein the gas tube assembly can be adjusted to achieve a desired alignment of the gas tube relative to a receiver assembly associated with an underlying firearm.

Many firearms that are capable of semi-automatic and automatic operation utilize at least a portion of the gas associated with discharge of the firearm to operate the action of the firearm or to cycle the action of the firearm to eject a spent shell casing and chamber a subsequent round of ammunition. As is commonly understood, semi-automatic operation of the firearm allows discharge of the firearm with each trigger actuation wherein automatic operation of the firearm provides sequential discharge of multiple rounds of ammunition while the trigger remains depressed. It is further appreciated that such firearms can also be configured to operate in a "burst" mode wherein multiple projectiles can be fired with each trigger actuation. Such firearms commonly allow the user to sequentially discharge multiple rounds of ammunition via only interaction with the trigger whereas single round firearms commonly require user operation of a bolt, hammer, or pump action to effectuate discharge of a spent munition casing and chambering of a subsequent round of ammunition.

In gas operation, a portion of high-pressure gas from the cartridge being fired is used to power a mechanism to extract the spent case and chamber a new cartridge. Energy from the gas is harnessed through either a port in the barrel or trap at the muzzle. This high-pressure gas impinges on a surface such as a piston, a tappet, connecting rod, bolt carrier, or a surface associated with the action or bolt carrier to provide motion for unlocking of the action, extraction of the spent case, ejection, cocking of the hammer or striker, chambering of a fresh cartridge, and subsequent locking of the action. In many semi-automatic and automatically operable rifles, a gas tube extends in a longitudinal direction along a rearward oriented portion of the barrel and is utilized to redirect a portion of the discharge gas stream toward the action to effect the automatic operation of the action to effectuate the automatic operation of the action. Firearms having such gas tubes are susceptible to various drawbacks.

When improperly oriented relative to the action, such systems can result in weapon disturbance due to balance shifting during the action cycle and can undesirably increase the weight of the resultant weapon. Further, being exposed to the discharge gases, such gas tubes can achieve operating temperatures that could burn the user if the user inadvertently contacts the gas tube after even short periods of operation of the firearm. To improve heat dissipation, such gas tubes are commonly exposed to atmosphere and formed as generally round tubular structures oriented along the upper surface of the barrel proximate a forward facing end of the receiver which supports the action of the firearm. In many configurations, a piston, tappet, connecting rod, or portion of a bolt carrier slideably cooperates with at least a portion of a chamber or passage defined by the gas tube. The desired cyclic operation of the firearm requires a generally coaxial alignment of the piston or the structure that is intended to be translated by the gas stream and the chamber or passage of the gas tube to maintain the generally slideable cooperation of the piston or bolt carrier and at least a portion of the gas tube. That is, a less than desired alignment between the gas tube assembly and the receiver assembly can result in jamming of the action and/or the piston during operation of the firearm due to misalignment and/or premature degradation of firearm action lubrication.

Unfortunately, the connection methodology associated with securing the gas tube assembly relative to the receiver assembly commonly provides a singular interface wherein the gas tube is either secured relative to the receiver assembly or removable therefrom. Such connection methodologies require generally exact machining tolerances to achieve and maintain the desired alignment of gas tube assembly and the receiver assembly during operation of the firearm. Such tolerances increase the cost associated with manufacturing such firearms and detract from serviceability of the same.

Such gas tube assemblies also commonly have a generally round exterior profile and extend a significant distance forward of an upper portion of the forward end of the receiver. The shape and location of the gas tube relative to the receiver complicates the ability to secure accessories such as sighting and light accessories relative to the underlying firearm. Unfortunately, the location of the gas tube relative to the underlying firearm at a location forward of the receiver and generally above the barrel is the same location that many users would prefer to secure to accessories, particularly sighting accessories, relative to the underlying firearm. That is, when engaged with the firearm, the longitudinal distance associated with the gas tube is commonly directly below the line of sight associated with the desired operation of the firearm and at a location between the eye of the user and a muzzle of the firearm that is more desirable for the mounting of sighting optics, lights, and the like. Unfortunately, accommodating the gas tube with the desired spacing to adjacent structures complicates the ability to secure such accessories to the underlying firearm at the more desirable locations.

Therefore, there is a need for a firearm gas tube assembly and firearms having a gas tube assembly that can be secured in the underlying firearm in an adjustable manner to achieve and maintain the desired alignment of the gas tube assembly and the receiver assembly to maintain the desired repeatable and cyclic operation of the underlying firearm. There is a further need for a firearm gas tube assembly that can accommodate greater deviation associated with the desired cooperation of the gas tube assembly and the associated receiver assembly. There is a further need for a firearm gas tube assembly that facilitates expedient and convenient securing of accessories such as sighting devices relative to the underlying firearm.

SUMMARY OF THE INVENTION

The present invention provides a firearm gas tube assembly, firearm assembly, or system, and method of forming a firearm gas tube assembly that overcomes one of more the aforementioned drawbacks. One aspect of the invention discloses a firearm gas tube assembly for semiautomatic firearms wherein the gas tube assembly is defined by a body having a first end, a second end, and a passage formed through the body between the respective ends. The first end of the body of the gas tube assembly is constructed to cooperate with a retainer or gas block and the second end of the body is constructed to cooperate with a forward facing end of a receiver assembly. A first projection and a second projection each extend in a respective outward radial direction from the body proximate the second end of the body and a respective adjuster is associated with each respective projection. The adjusters are configured to movably cooperate with the respective projection to align the second end of the body relative to the receiver assembly. Such as construction allows the position of the gas tube assembly relative to the receiver assembly to be adjusted to achieve the desired operation of the underlying firearm assembly.

Another aspect of the invention discloses a firearm gas tube assembly having a body that includes a passage formed through the body between a first end and a second end of the body. The first end of the body is constructed to cooperate with a fore end retainer such as a gas block and the second end is constructed to cooperate with a rear end retainer, a rear sight block, or other such structure associated with a forward facing portion of a receiver assembly. A first projection and a second projection extend in respective outward radial directions from the body proximate the second end. A first adjuster is associated with the first projection and a second adjuster associated with the second projection. Each of the first adjuster and the second adjuster are configured to movably cooperate with a respective one of the first projection and the second projection to align the second end of the body relative to the receiver assembly.

Another aspect of the invention discloses a firearm assembly that includes a receiver and a barrel attached to a forward facing end of the receiver. A retainer or gas block is attached to the barrel and a gas tube is disposed between the receiver and the gas block generally above a portion of the barrel. An adjustable support assembly is defined by the gas tube and oriented to engage the barrel proximate the receiver. The adjustable support assembly is operable to facilitate the desired alignment of the gas tube relative to the receiver.

A further aspect of the invention discloses a method of forming a semiautomatic rifle gas tube assembly. The method includes providing a gas tube that has a forward facing end that is constructed to cooperate with a retainer or gas block that is attached to a barrel of a firearm and a rearward facing end that is constructed to cooperate with a receiver assembly. An adjustable alignment assembly is provided that is configured to engage the barrel of the firearm proximate the rearward facing end of the gas tube such that operation of the alignment assembly manipulates a position of the rearward facing end of the gas tube relative to the receiver assembly.

These and other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
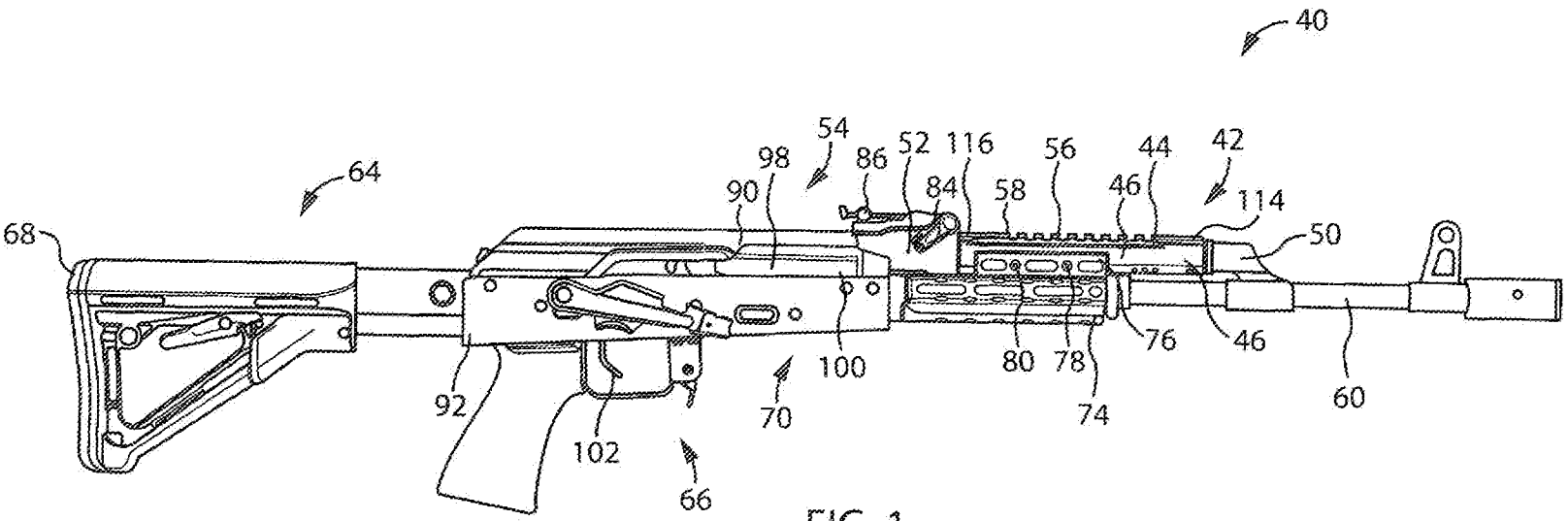
FIG. 1 is a side elevation view of an exemplary firearm equipped with a gas tube assembly according to the present invention.
Figure 2:
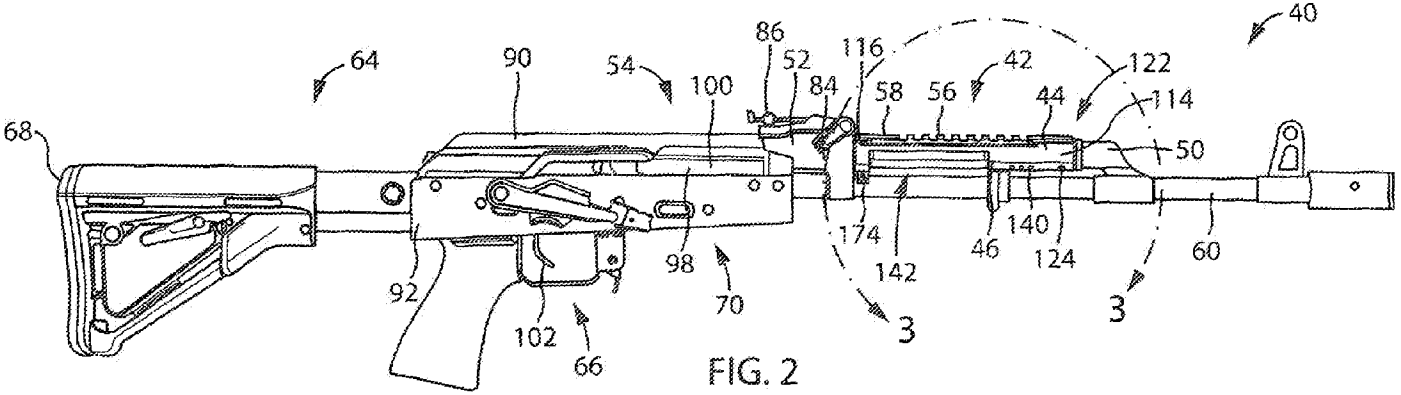
FIG. 2 is a view similar to FIG. 1 with a fore grip and a clamp assembly removed therefrom.
Figure 3:
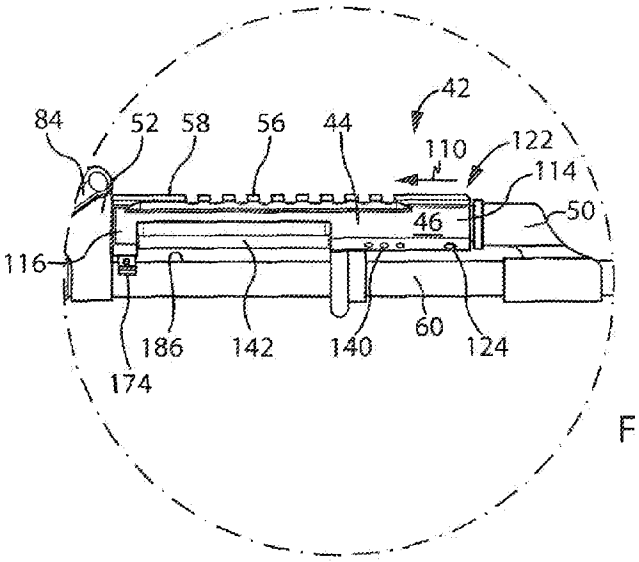
FIG. 3 is a side elevation detail view of the gas tube assembly shown in FIG. 1.

FIG. 1 shows a semiautomatic firearm assembly, referred to hereafter as firearm 40, equipped with a gas tube assembly 42 according to the present invention. Referring to FIGS. 1-3, gas tube assembly 42 includes a gas tube 44 that is defined by a body 46 that extends between a forward gas block or fore gas tube retainer 50 and an aft, receiver end, rear sight block, or rearward gas tube retainer 52 that is positioned proximate receiver assembly 54. It is appreciated that aft gas tube retainer 52 can be formed as a structure that removably cooperates with receiver assembly 54 or formed integrally by receiver assembly 54. Gas tube assembly 42 removably cooperates with the underlying firearm 40 to effectuate breakdown and/or servicing of the firearm 40.

Body 46 of gas tube 44 preferably includes an accessory engagement interface or mount arrangement 56 formed along at least a portion of one or more of the top or lateral sides of the gas tube. Preferably, accessory mount arrangement 56 is formed along a portion of an upper facing surface 58 of the body 46. Arrangement 56 is constructed to accommodate tool-less removable securing of accessories, such as scopes, other sighting devices, lights, etc., relative to the underlying firearm assembly. Firearm 40 includes a barrel 60 that extends in a longitudinal direction between a muzzle 62 and receiver assembly 54. A stock or stock assembly 64 extends generally rearward of receiver assembly 54. Receiver assembly 54 supports a trigger assembly 66 such that trigger assembly 66 is disposed between a butt 68 defined by stock assembly 64 of firearm 40 and barrel 60. Firearm 40 preferably includes a magazine cavity 70 associated with accommodating a number of rounds of ammunition. As is commonly understood, user interaction with trigger assembly 66 is associated with discharging firearm 40.

As shown in FIG. 1, a fore grip hand guard 74 extends along a portion of an underside of barrel 60. A gusset or clamp assembly is provided in the form of a pair of clamp portions of bodies 76 that extend between gas tube 44 and fore grip hand guard 74 along generally opposite lateral sides of firearm 40. One or more fastener 78, 80 extend in a lateral direction and secure the clamp bodies 76 relative to firearm 40. As described further below, rearward gas tube retainer 52 associated with receiver assembly 54 includes a catch, indicated by handle 84, that is operable to allow selective removal of gas tube assembly 42 from the underlying firearm 40 when desired. Rearward gas tube retainer 52 preferably includes a rear sight device, such as an adjustable iron sight 86, associating with aiming of firearm 40 when no other sighting accessories are available. Rearward gas tube retainer 52 is formed integrally with or attached to an upper portion 90 of receiver assembly 54. Receiver assembly 54 include a lower portion 92 that generally defines magazine cavity 70 and is constructed to support trigger assembly 66 and operators, such as safety devices, fire selection devices, magazine/bolt catch/release assemblies, etc.

As commonly understood, receiver assembly 54 generally encloses an action 98 associated with operation of firearm 40. Action 98 includes a bolt 100 that is constructed to oscillate in the longitudinal direction relative to firearm 40 to effectuate cyclic operation of the firearm to chamber a round of ammunition, actuate discharge of a chambered round in response to actuation of the trigger 102, discharge spent shell casings, and chamber subsequent rounds of ammunition when available. It is appreciated by those skilled in the art that such firearms can be quickly configured to single round operation, semi-automatic, burst, or fully automatic operation depending on the user's preferences and/or tactical situation conditions. It is further appreciated that discharge of a round of ammunition effectuates operation of the gas system to effectuate the cyclic operation of action 98 of firearm 40.

It is further appreciated that such gas controlled operations of the underlying firearm can be provided in various configurations. That is, in some configurations, a structure such as a short or long stroke piston slideably cooperates with the passage defined by gas tube body 46. In other configurations, a connecting rod is disposed between the gas system and the action to effectuate the desired operation of the action. Still in other configurations, the gas associated with the gas tube assembly impinges upon a tappet or other structure to effectuate the rearward or cyclic operation of the action in response to a discharge event. Regardless of the specific configuration, the gas tube assembly must be maintained in a desired and secure orientation relative to the receiver assembly to achieve the desired interaction between the gas system and the mechanical components of the action 98.

Referring to FIGS. 2 and 3, during operation of firearm 40, as a projectile is discharged, a portion of the gas associated with the discharge event is ported into a cavity or passage defined by gas tube 44 via fore gas tube retainer 50. Fore gas tube retainer 50 is secured to barrel 60 and includes a port that is internal to the retainer and exposed to the bore defined by barrel 60. As a projectile passes the port defined by retainer 50, a portion of the gas stream associated with propulsion of the projectile is directed into gas tube assembly 42. The gas ported into gas tube assembly 42 travels in a generally rearward direction, indicated by arrow 110, and acts upon a piston, connecting rod, tappet or other structure that is slideably associated the passage defined by body 46 of gas tube 44, or a rearward oriented end thereof, as disclosed further below to effectuate rearward translation of action 98. The gas pressure directed in direction 110 effectuates the rearward translation of action 98 to effectuate discharge or ejection of spent shell casings and thereby accommodating chambering of a subsequent round of ammunition when available.

Figure 4:
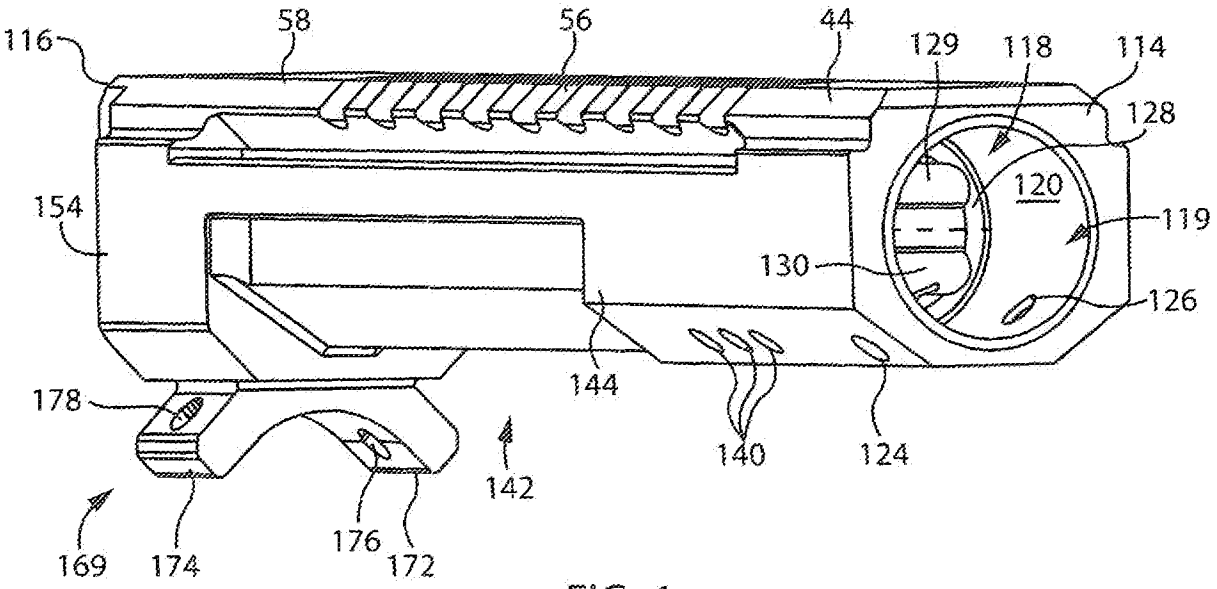
FIG. 4 is a fore end perspective view of the gas tube assembly shown in FIG. 1.
Figure 5:
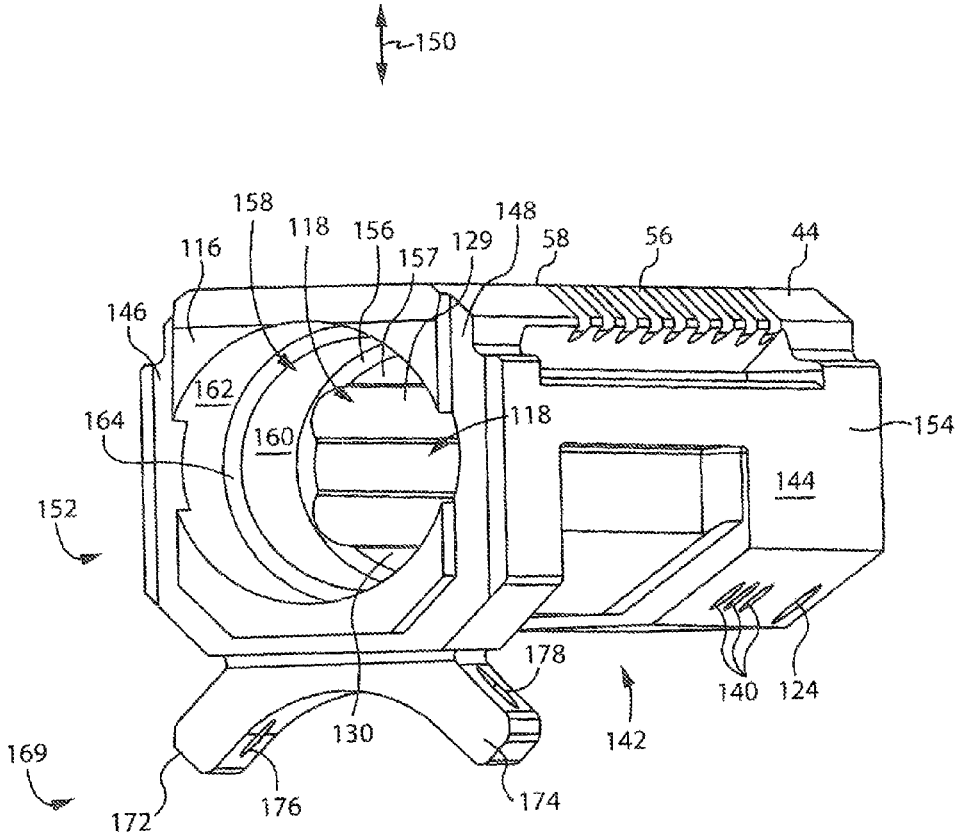
FIG. 5 is rear or receiver end perspective view of the gas tube assembly shown in FIG. 1.
Figure 6:
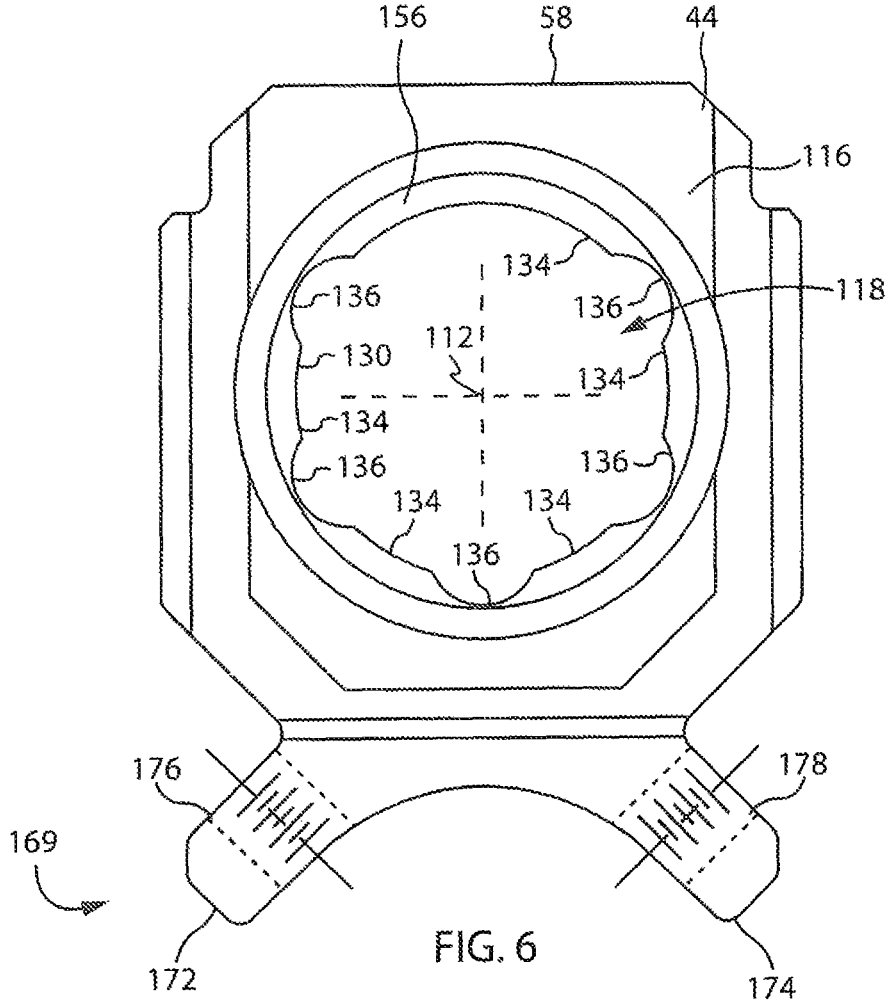
FIG. 6 is a rear elevation view of the gas tube assembly shown in FIG. 1.

Referring to FIGS. 4-6, body 46 of gas tube assembly 42 extends in a longitudinal direction 112 (FIG. 7) between a first or forward end 114 and a second, aft, rearward, or receiver facing end 116. An elongated chamber or passage 118 extends the longitudinal length of body 46 between forward end 114 and receiver facing end 116 of body 46. A first portion 119 of an interior facing surface 120 of body 46 is disposed proximate forward end 114 of body 46 and is shaped to slideably cooperate with a stem 122 (FIGS. 2 and 3) defined by forward gas tube retainer 50. One or more openings 124, 126 extend in a generally downward oriented radial direction relative to first portion 119, of body 46. Openings 124, 126 are constructed to receive fasteners associated with securing body 46 of gas tube assembly 42 relative to retainer 50. A land 128 is formed between a first portion 119 of passage 118 and a second portion 129 of passage 118. First portion 119, and/or land 128 are constructed to provide a sealed interaction between forward end 114 of gas tube body 46 and stem 122 associated with retainer 50. It is appreciated that other configurations are capable of provide such a physically secure and operatively sealed interaction between forward end 114 of gas tube body 46 and fore gas tube retainer 50.

Second portion 129 of passage 118 includes an interior surface 130 that has a generally uniform profile along longitudinal axis 112 and includes a number of lands 134 that are separated from one another by a number of grooves 136. Lands 134 and grooves 136 can be provided in various other shapes, such as more generally circular cross-sectional shape to accommodate slidable interaction with a piston, connecting rod, or other slideable component associated therewith, as described further below with respect to FIG. 7. As shown in FIGS. 4 and 5, one or more ports or vents 140 extend in a generally radial direction through body 46 and fluidly connect passage 118 to atmosphere. Although vents 140 extend through body 46 in generally opposite lateral downward oriented directions relative to firearm 40, other orientations are envisioned. Vents 140 are oriented to mitigate subjecting the slidable component associated with operation of the action to over pressure conditions. Vents 140 are also oriented to mitigate subjecting the operator to the gaseous materials vented through the respective vents 140.

A cutout 142 is formed in an exterior facing surface 144 of gas tube body 46. Cutout 142 is oriented generally rearward of vents 140 and forward of receiver facing end 116. Cutout 142 extends about exterior surface 144 so as to generate a generally mirror image on opposite lateral sides of body 46. Referring briefly to FIGS. 1 and 4, cutout 142 is shaped to cooperate with opposing clamp bodies 76 and fasteners 78, 80 associated therewith. Although it should be understood that gas tube assembly 42 is captured in a longitudinal direction between fore gas tube retainer 50 and receiver end gas tube retainer 52, the cooperation of clamp bodies 76, with body 46 and fore grip hand guard 74 enhance the robust connection of gas tube assembly 42 relative to the underlying firearm 40.

Referring back to FIGS. 5 and 6, receiver facing end 116 of body 46 of gas tube assembly 42 includes a pair of channels 146, 148 that extend in a generally vertical direction, indicated by arrow 150, along generally opposite lateral sides 152, 154 of body 46. Channels 146, 148, are shaped to allow receiver facing end 116 of body 46 to slideably cooperate with the rearward or receiver oriented gas tube retainer 52 when gas tube assembly 42 is translated in direction 150 relative to barrel 60 and when handle 84 is oriented in an open position. A land 156 is oriented between a rearward facing end 157 of second portion 129 of passage 118 and a third portion 158 associated therewith. Third portion 158 of passage 118 includes a first section 160 and a second section 162 that have dissimilar diameters. As shown in FIG. 5, first section 160 of third portion 158 of passage 118 has a smaller diameter than second section 162 such that an additional land 164 is disposed between the respective sections 160, 162.

Sections 160, 162, and lands 156, 164 associated with third portion 158 of passage 118 are shaped to at least loosely sealingly cooperate with a slideable mechanism or assembly, such as a connecting rod, a tappet, piston, etc., as examples of slideable mechanism 170 (FIG. 7), associated with the operation of action 98 in response to the gas flow through gas tube assembly 42. As alluded to above, the "sealed" interaction need not necessarily be gas tight but is rather sufficient to achieve the desired operation of mechanism 170 even if some degree of seal blow-by occurs. The slideable mechanism 170 associated with operation of action 98 preferably includes a seal feature, such as one or more metal rings 171, that are supported by mechanism 170 and slideably cooperate with one or more of first section 160, second section 162, land 164, or an other internal facing surface associated with passage 118 of gas tube assembly 42 to achieve the desired interaction between the gas operation system and the remainder of the mechanically operated assembly of the action 98.

Figure 7:
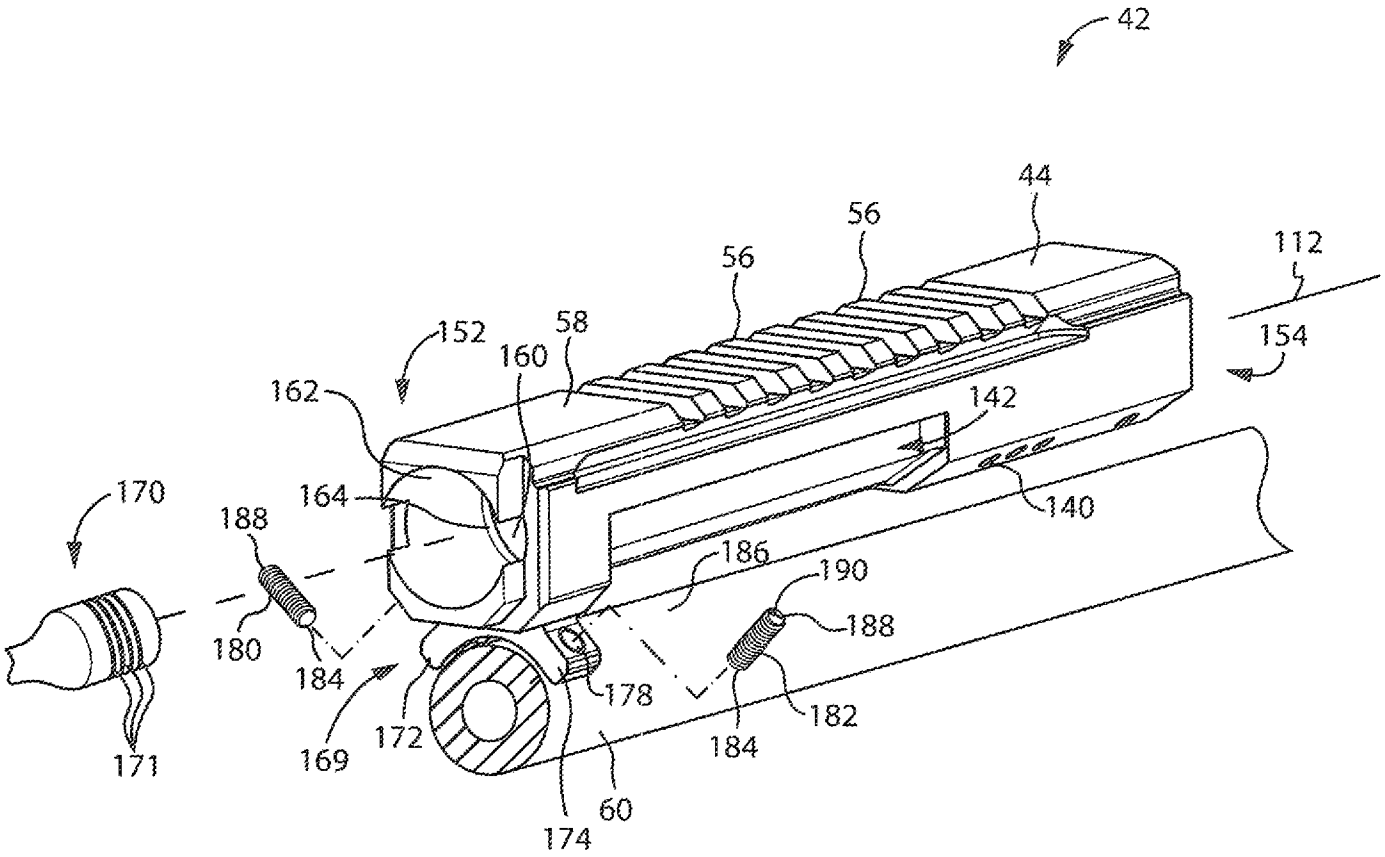
FIG. 7 is a view similar to FIG. 5 and shows the gas tube assembly shown in FIG. 1 associated with a barrel and a slideable structure associated with operation of an action of the underlying firearm loosely associated therewith.

Referring to FIGS. 5-7, gas tube assembly 42 includes an adjustable support or alignment assembly 169 that is defined by a first projection 172 and a second projection 174 that each extend in generally outward radial directions relative to the remainder of body 46. Projections 172, 174 are oriented to generally flank an upper facing portion of the barrel 60 disposed proximate receiver assembly 54 when firearm 40 is assembled. Each projection 172, 174 includes a threaded opening 176, 178 that is constructed to cooperate with a respective adjuster such as a threaded fastener 180, 182. As shown in FIG. 7, each fastener 180, 182 includes a first end 184 that is configured to be in contact engagement with an upper facing surface 186 of barrel 60. A second end 188 of each fastener 180, 182 includes a driver arrangement 190, such as slot, hex key blind hole, etc., that is configured to allow the operator to manipulate the orientation of fasteners 180, 182 relative to the discrete projections 172, 174 associated with body 46 of gas tube assembly 42.

Manipulation of fasteners 180, 182 alters the position of receiver facing end 116 of gas tube assembly 42 relative to barrel 60 and thereby manipulates the position of gas tube assembly 42, and particularly axis 112, relative to the receiver or rearward gas tube retainer 52 such that axis 112 can be effectively aligned with or coaxial with the axis associated with the longitudinal operation of the gas driven action structure such as piston 170. Operation of fasteners 180, 182 alters a distance associated with a gap between barrel 60 and flanges 172, 174 to achieve the desired alignment of the axis associated with operation of piston 170 and axis 112 defined by gas tube body 46. It should be appreciated that when fully retracted, direct interaction between projections 172, 174 and barrel 60 defines the relative orientation or alignment between axis 112 and piston 170. It should be further appreciated that the independent operation of fasteners 180, 182 allows some degree of rotational alignment between axis 112 and the axis of operation associated with piston 170.

Further, when receiver gas tube retainer 52 is engaged with receiver facing end 116 of gas tube assembly 42, operation of one or more of fasteners 180, 182 can effectively bias gas tube assembly 42 toward the latch mechanism associated with rearward gas tube retainer 52 without detrimentally affecting the coaxial alignment of the gas tube assembly 42 with the slideable operator, such as piston 170, associated with action 98 to mitigate unintentional or vibrational opening of the latch associated with rearward gas tube retainer 52 during rough or extended periods of use of firearm 40.

Therefore, one embodiment of the invention includes a firearm gas tube assembly having a body that includes a passage formed through the body between a first end and a second end of the body. The first end of the body is constructed to cooperate with a fore end retainer such as a gas block and the second end constructed to cooperate with a rear end retainer, a rear sight block, or other such structure associated with a portion of a receiver assembly. A first projection and a second projection extend in respective outward radial directions from the body proximate the second end. A first adjuster is associated with the first projection and a second adjuster associated with the second projection. Each of the first adjuster and the second adjuster are configured to movably cooperate with a respective one of the first projection and the second projection to align the second end of the body relative to the receiver assembly.

Another embodiment that includes or is combinable with one or more of the features or aspects of the above embodiments includes a firearm assembly. The firearm assembly includes a receiver and a barrel attached to a forward facing end of the receiver. A retainer or gas block is attached to the barrel and a gas tube is disposed between the receiver and the gas block generally above a portion of the barrel. An adjustable support assembly is defined by the gas tube and oriented to engage the barrel proximate the receiver to operable to facilitate alignment of the gas tube with the receiver.

A further embodiment that includes or is combinable with one or more of the features, aspects of the above embodiments includes a method of forming a semiautomatic rifle gas tube assembly. The method includes providing a gas tube that has a forward facing end that is constructed to cooperate with a retainer or gas block that is attached to a barrel of a firearm and a rearward facing end that is constructed to cooperate with a receiver assembly. An adjustable alignment assembly is provided that is configured to engage the barrel of the firearm proximate the rearward facing end of the gas tube such that operation of the alignment assembly manipulates a position of the rearward facing end of the gas tube relative to the receiver assembly.

The present invention has been described in terms of the preferred embodiment, the embodiment disclosed herein is directed to the assembly as generally shown in the drawings. It is recognized that equivalents, alternatives, and modifications, aside from those expressly stated, to the embodiments summarized, or the embodiment shown in the drawings, are possible and within the scope of the appending claims. The appending claims cover all such alternatives and equivalents.

What is claimed is:

1. A firearm gas tube assembly comprising:

a body having a first end constructed to cooperate with a gas block and a second end constructed to cooperate with a forward facing end of a receiver assembly;

a passage formed through the body;

a first projection and a second projection, each of the first projection and the second projection extending in a respective outward radial direction from the body proximate the second end; and a first adjuster associated with the first projection and a second adjuster associated with the second projection, each of the first adjuster and the second adjuster configured to movably cooperate with a respective one of the first projection and the second projection to align the second end of the body relative to the receiver assembly.

2. The firearm gas tube assembly of claim 1 further comprising a piston configured to slideably cooperate with the passage formed through the body.

3. The firearm gas tube assembly of claim 2 further comprising a bolt carrier configured to cooperate with a bolt of a firearm, the bolt carrier configured to translate in response to movement of the piston in the body.

4. The firearm gas tube assembly of claim 1 wherein the forward facing end of the receiver assembly is further defined as a rear sight block and includes a catch constructed to secure the second end of the body relative to the receiver assembly.

5. The firearm gas tube assembly of claim 1 wherein the first adjuster and the second adjuster are further defined as set screws that rotationally cooperate with a respective threaded passage associated with a respective one of the first projection and the second projection.

6. The firearm gas tube assembly of claim 1 wherein the first adjuster and the second adjuster are constructed to engage generally opposite lateral upper facing sides of a barrel.

7. The firearm gas tube assembly of claim 1 further comprising an accessory interface formed along at least one exterior facing side of the body.

8. A firearm assembly comprising:

a receiver, a barrel attached to a forward facing end of the receiver;

a gas block attached to the barrel;

a gas tube disposed between the receiver and the gas block; and an adjustable support assembly defined by the gas tube and oriented to engage the barrel proximate the receiver to align the gas tube with the receiver.

9. The firearm assembly of claim 8 wherein the adjustable support assembly is further defined as a pair of projections and a pair of set screws wherein each of the pair of set screws movably cooperates with a respective one of the pair of projections.

10. The firearm assembly of claim 9 wherein the pair of projections generally flank opposite lateral sides of an upper surface of the barrel.

11. The firearm assembly of claim 10 wherein the pair of set screws are configured to engage the barrel and define an adjustable gap between a respective one of the pair of projections and the barrel during movement of a respective one of the pair of set screws.

12. The firearm assembly of claim 8 further comprising a piston that slideably cooperates with a passage defined by the gas tube.

13. The firearm assembly of claim 12 further comprising a bolt carrier attached to the piston and movable relative to the receiver to effectuate rearward translation of a bolt relative to the receiver.

14. The firearm assembly of claim 8 further comprising a first clamp body and a second clamp body that cooperate with respective opposite lateral sides of the gas tube and overlap a portion of the barrel.

15. The firearm assembly of claim 8 further comprising a rear sight block disposed between the receiver and the gas tube, the rear sight block configured to cooperate with a rearward facing end of the gas tube.

16. A method of forming a semiautomatic rifle gas tube assembly, the method comprising:

providing a gas tube having a forward facing end that is constructed to cooperate with a gas block attached to a barrel of a firearm and a rearward facing end that is constructed to cooperate with a receiver assembly; and providing an alignment assembly proximate the rearward facing end of the gas tube that is configured to engage the barrel of the firearm such that adjustment of the alignment assembly manipulates a position of the rearward facing end of the gas tube relative to the receiver assembly.

17. The method of claim 16 wherein providing the alignment assembly further comprises extending a first projection and a second projection from a body of the gas tube to extend along generally opposite lateral upper sides of the barrel of the firearm.

18. The method of claim 17 wherein providing the alignment assembly further comprises engaging an adjuster with one of the first projection and the second projection such that the adjuster engages the barrel and movement of the adjuster translates the rearward facing end of the gas tube relative to the barrel.

19. The method of claim 18 further comprising engaging another adjuster with the other of the first projection and the second projection such that the another adjuster engages the barrel and movement of the another adjuster translates the rearward facing end of the gas tube relative to the barrel.

20. The method of claim 16 further comprising providing a clamp assembly that is constructed to cooperate with the gas tube assembly between the forward facing end and the rearward facing end and overlap a portion of the barrel.

* * * * *